US005570079A

United States Patent [19]

Dockery

[11] Patent Number: 5,570,079

[45] Date of Patent: Oct. 29, 1996

[54] HOME SECURITY SYSTEM FOR DETECTING AN INTRUSION INTO A MONITORED AREA BY AN INFRARED DETECTOR

[76] Inventor: Devan Dockery, Rte. 8, Box 14, Defuniak Springs, Fla. 32433

[21] Appl. No.: 427,433

[22] Filed: Apr. 24, 1995

[51] Int. Cl.[6] ..... G08B 13/19

[52] U.S. Cl. ..... 340/541; 340/539; 340/567; 340/691

[58] Field of Search ..... 340/539, 691, 340/541, 567

[56] References Cited

U.S. PATENT DOCUMENTS

| | | | |
|---|---|---|---|
| 3,833,895 | 9/1974 | Fecteau | 340/539 |
| 4,134,108 | 1/1979 | Palmer et al. | 340/539 |
| 4,143,368 | 3/1979 | Route et al. | 340/543 |
| 4,507,654 | 3/1985 | Stolarczyk et al. | 340/545 |
| 4,746,910 | 5/1988 | Pfister et al. | 340/567 |
| 4,751,396 | 6/1988 | Daigle et al. | 307/10.2 |
| 4,760,381 | 7/1988 | Haag | 340/556 |
| 4,797,657 | 1/1989 | Vorzimmer et al. | 340/541 |
| 4,797,663 | 1/1989 | Rios | 340/541 |
| 4,833,449 | 5/1989 | Gaffigan | 340/539 |
| 4,868,543 | 9/1989 | Binkley | 340/569 |
| 5,440,292 | 8/1995 | Bedrosian | 340/567 |
| 5,461,365 | 10/1995 | Sclager et al. | 340/539 |

*Primary Examiner*—Glen Swann

*Attorney, Agent, or Firm*—Gifford, Krass, Groh, Sprinkle, Patmore, Anderson & Citkowski, P.C.

[57] ABSTRACT

A security system has a flee-standing intrusion detector. The free standing intrusion detector has a transmitter coupled with a portable receiver to alert a homeowner that an intrusion has taken place or occurred within a pre-set time period. The area under surveillance is monitored by an infrared detector which activates the transmitter upon the detection of abrupt differences in infrared radiation levels, associated with the presence of a warm body in an otherwise equilibrated environment. A radio signal is emitted by the transmitter which is received by the portable hand-held remote receiver. A first signal, indicating that an intrusion has been detected less than a preselected period of time in the past in the monitored areas, is displayed on the receiver for that preselected period of time. After the preselected period of time has elapsed, a second signal is generated to indicate that the intrusion took place at a time greater than the preselected period of time in the past and that the probability of the intruder still being present is less. Once the intrusion detector is activated, the signal is continuously transmitted to the portable receiver until the intrusion detector has been reset.

19 Claims, 1 Drawing Sheet

HOME SECURITY SYSTEM FOR DETECTING AN INTRUSION INTO A MONITORED AREA BY AN INFRARED DETECTOR

FIELD OF THE INVENTION

The present invention relates to a home security system and in particular a home security system which detects an intrusion in a monitored area with an infrared detector and includes a transmitter which transmits a time related radio signal to a portable receiver in the possession of the homeowner.

DESCRIPTION OF THE PRIOR ART

A simple method of sensing an intrusion electronically is via infrared detection. Varying levels of infrared radiation are monitored either actively, by first emitting IR and then evaluating the reflected signal, or passively, by only receiving the infrared frequencies radiating in the monitored area. Once a variation has been detected, the system must communicate the state of alarm. Several security systems employ telephone lines as a means to alert authorities, while other methods rely on door or window switches to trigger an alarm. These systems are both costly and difficult to install. Furthermore, if the homeowner is neither accessible by phone nor within sight of his home, he cannot be prevented from encountering the intruder while the intruder is still on the premises. If the homeowner could be made aware of the intrusion and how long ago the intrusion occured, he could decide whether or not he should enter his home.

The present invention provides means for passively sensing an intrusion, and transmitting the signal to a portable receiver in the homeowner's possession. The signal transmitted to the portable receiver being coded to reference the time of intrusion to the present time.

Although prior art alludes to these aspects of a security system, the three have not been effectively combined to warn the homeowner that an intrusion has occured within a certain time frame, independent of external circuitry or phone lines.

An infrared intrusion detector which transmits to a portable receiver alerting a security officer and triggering a visual alarm is disclosed in U.S. Pat. No. 4,797,657 issued Jan. 10, 1989 to Vorzimmer et al. Unlike the present invention, the device taught by Vorzimmer et al. contains no mechanism which provides a reference as to when the intrusion took place. Although the theory of transmitting a radio signal to a remote portable receiver is also used in the present invention, the purpose of transmission in the system taught by Vorzimmer et al. is to notify security personnel as soon as possible that an intrusion is currently in progress. It is not necessarily desirable for security personnel to be aware that an intrusion occurred at least thirty minutes ago.

The invention discussed in U.S. Pat. No. 4,868,543 to Binkley, however does implement a timer to control the power supply to an infrared mail sensing device. The timer is actuated by a closed switch physically connected to the mailbox door and by the detection of reflected IR waves. The timer of the present invention is not activated by either of these means. Whereas the Binkley device relies on the generation, reflection and reception of IR waves, the present invention merely receives changes in the temperture resulting from body heat caused by movement of a person into the view of the detector lens. No external wiring for door or window switches is necessary to activate the present device.

SUMMARY OF THE INVENTION

The invention senses an intrusion by the reception of abrupt changes in IR levels as sensed by an IR receiving diode. Once the intrusion has been detected, an SCR triggered by the IR receiving diode supplies electrical energy activating a transmitter and a timer. The transmitter remains activated until the SCR is manually reset. The timer, in turn, supplies electrical power to a blinker circuit which modulates the RF (radio) signal being generated by the transmitter for a pre-set time. After this time has elapsed, the output of the blinker circuit ceases, terminating the modulation of the RF signal while the SCR continues to power the transmitter. The output of the transmitter modulated by the blinker is displayed for the pre-set time on a portable receiver device. This signal indicates that the system detected an intrusion within a fixed period of time, such as within the last thirty minutes. Subsequently, a steady signal is displayed on the portable receiver device. This steady signal indicates that an intrusion was detected at least thirty minutes ago. The system also provides means for coding the transmitted radio signal for exclusive reception by the portable receiving device. In addition, a timer delay circuit is incorporated into the security system which allows a homeowner enough time to activate the system and exit the area without triggering an alarm.

BRIEF DESCRIPTION OF THE DRAWINGS

A better understanding of the present invention will be had upon reference to the following detailed description when read in conjunction with the accompanying drawing which is a block diagram view illustrating a preferred embodiment of the present invention.

DETAILED DESCRIPTION OF THE PREFERRED EMBODIMENTS OF THE PRESENT INVENTION

Figure 1:
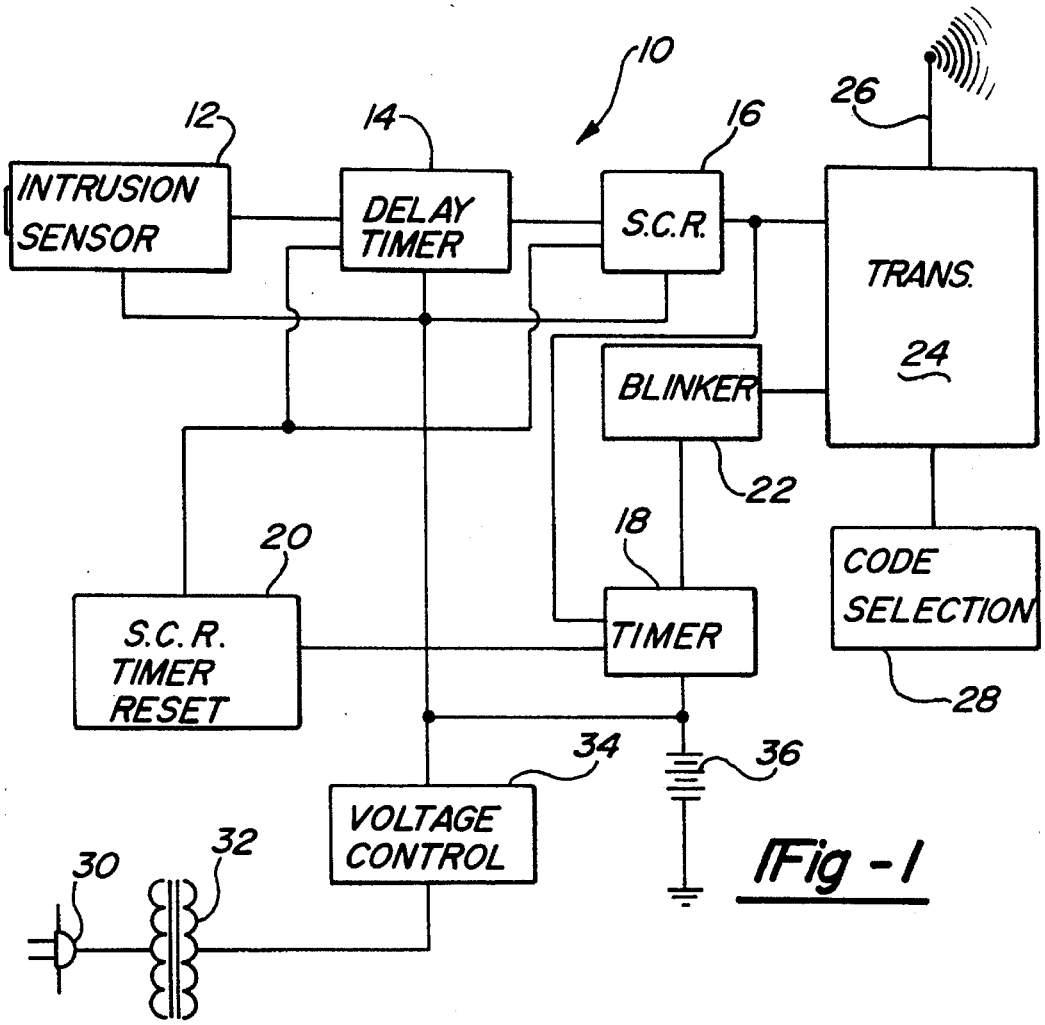
FIG. 1 is a block diagram of the intrusion detector device.
Figure 2:
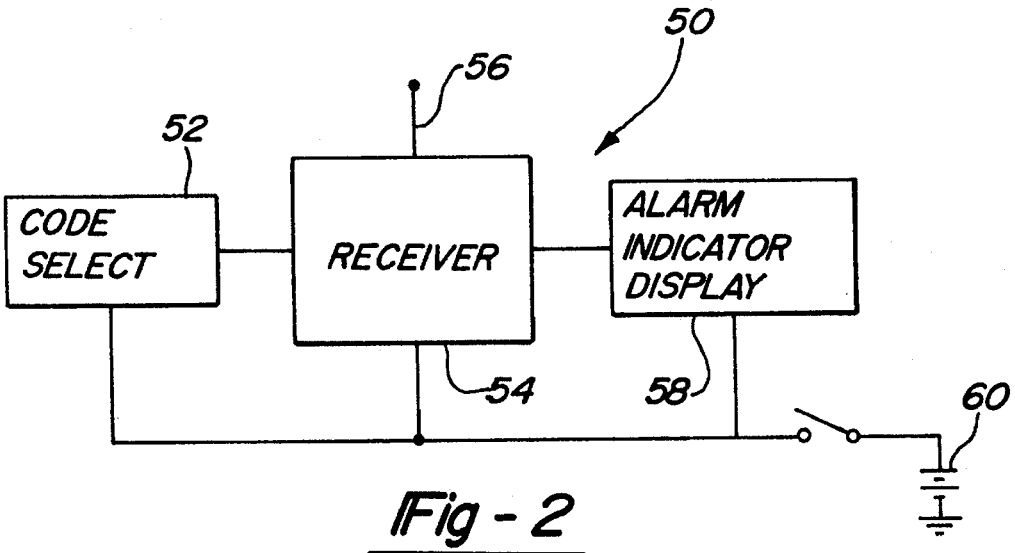
FIG. 2 is a block diagram of the portable receiver device.

With reference to the FIGS. 1 and 2, a preferred embodiment of the present invention is illustrated and comprises an intrusion detector device 10 and a portable receiving device 50. Furthermore, as shown in FIG. 1 each intrusion detector device 10 includes an intrusion sensor 12 which is adapted to sense a variation in the emissions of infrared radiation in a monitored area. The intrusion sensor 12 is electrically connected to an SCR 16 through a delay timer, 14. Upon setting the intrusion detector device 10 to monitor the area, the delay timer 14 delays the activation of the intrusion detector device 10 by the intrusion detector 12 for a preset time.

Electrical power may be received from a conventional household electrical outlet by means of electrical wall plug 30, transformer 32 and voltage control circuit 34. The output of the voltage control circuit 34 is applied directly to the intrusion detector 12, delay timer 14 and SCR 16. Alternately the electrical power may be received from a battery 36. The intrusion sensor 12 generates an intrusion signal in response to a variation in infrared emissions in the monitored area after the delay timer 14 times out. The intrusion signal latches the SCR 16 to a conductive state. The SCR 16 remains in the conductive state until it receives a reset signal from the SCR/timer reset circuit 20. Furthermore, when the SCR 16 is latched on, a timer 18, electrically connected to a modulation or blinker circuit 22 is started. The timer 18 activates the blinker circuit 22 for a predetermined period of time after being activated.

The output signal of the blinker circuit 22 is connected as a modulation input signal to the transmitter 24 which generates a radio signal transmitted via antenna 26. The output of the blinker circuit 22 is a time dependant intermitent signal which modulates the radio signals generated by the transmitter 24. The SCR 16 provides electrical power to the transmitter 24 which continues to transmit steadily until physically reset via the SCR/timer reset circuit 20.

The SCR/timer reset circuit 20 can be activated by manually latching on an external switch (not shown) on the intrusion detector device 10. The SCR/timer reset circuit 20 resets the SCR 16, the timer 18, and the timer delay 14.

Furthermore, the transmitter 24 is connected to a transmitter code selection 28 circuit which digitally codes the signal for reception by the receiver antenna 56.

The hand-held receiving device 50 shown in FIG. 2 has a receiver 54, a receiver antenna 56, a receiver code selection 52 circuit, and an alarm indicator display 58. It operates remote from the transmitting device 10 on its own power supply. Typically, this power supply would be a battery 60. The receiver code selection 52 circuit is programmed to selectively receive the coded signal from the transmiter 24 of the intrusion device 10. The alarm indicator display 58, is electrically connected to the receiver circuit 54 generates a visual display in response to the signals received from the receiver 54 in response to the radio signals transmitted by transmitter 24.

When the transmitted radio signal is being modulated by the output of the blinker circuit 22 the alarm indicator 58 displays an intermittant or blinking visual signal, produced by a blinking light source such as a light emitting diode. This intermittent or blinking visual signal informs the homeowner that an intrusion has occured within the time which was preset into the timer 18. If the transmitted signal is not modulated by the blinker circuit 22, then the alarm indicator 58 displays a constant visual signal preferably, in the form of a constantly lighted light emitting diode. This constant visual signal notifies the homeowner that an intrusion had occurred at a time prior to the time duration which is preset into the timer. The period of time the blinker circuit 22 is activated by the timer 18 enables an approximation of the time relative to the current time when the intrusion occurred so as to warn the homeowner of the possibility that the intruder may still be in the home. For example, if the visual display is blinking, less than 30 minutes have elapsed since an intrusion was detected.

From the foregoing, it can be seen that the present invention provides a simple, inexpensive, and yet wholly effective system for detecting an intrusion as well as providing a warning to the homeowner of a potential encounter with an intruder if the visual signal displayed by the portable receiver is a blinking signal.

Having described my invention, however, many modifications thereto will become apparent to those skilled in the art to which it pertains without deviation from the spirit of the invention as defined by the scope of the appended claims.

I claim:

1. A security system for a home comprising:

a free standing intrusion detector to be set in an area of said home to be protected, said free standing intrusion detector comprising:

an intrusion detector to generate an intrusion signal in response to an intrusion into said area;

a radio signalling transmitter responsive to said intrusion signal to transmit a radio signal;

means for modulating said radio signal for a predetermined time in response to said intrusion signal; and time delay means for delaying the actuation of said intrusion detector to allow a person sufficient time to exit said area to be protected after setting said intrusion detector; and a portable receiver adapted to be hand carried comprising:

means for generating an output signal in response to said radio signal; and display means for generating a visual display indicating an intrusion has occured in response to said output signal.

2. The security system of claim 1 wherein the intrusion detector further comprises an independent source of electrical power enabling said intrusion detector to function independent of the power source of said home.

3. The security system of claim 2, wherein said intrusion-detector is an infrared sensor.

4. The security system of claim 2 wherein said independent source of electrical power is a battery.

5. The security system of claim 1 wherein said radio signalling transmitter further comprises means for encoding said radio signal, and wherein said portable receiver has means for making said portable receiver selectively responsive to said encoded radio signal.

6. The security system of claim 1 wherein said means for modulating further comprises a timer which counts down a pre-set number of minutes.

7. The security system of claim 1 wherein said display means is a visual indicator.

8. The security system of claim 7 wherein said visual indicator is at least one light-emitting diode.

9. The security system of claim 1 wherein said means for modulating said radio signals modulates said radio signals with time-dependent intermittent signals for said predetermined period of time.

10. The security system of claim 9 wherein a steady signal is transmitted after the expiration of said predetermined period of time.

11. The security system of claim 1 having a switch responsive to said intrusion signal to provide electrical power to said radio signalling transmitter means and said means for modulating.

12. The security system of claim 11 wherein said switch is an SCR.

13. The security system of claim 12 further comprising a reset means for manually resetting said means for modulating, said time delay means and said SCR after the occurance of an intrusion.

14. A home security system comprising:

a free-standing intrusion detector to be set in an area to be protected which when activated will initiate an alarm sequence, said intrusion detector having intrusion detector means for detecting all intrusion, transmitter means for transmitting a radio signal in response to said intrusion detection, and timing means activated by said intrusion detector means, said timing means including means for modulating said radio signal transmitted by said transmitter means to produce a modulated radio signal for a preselected period of time after said intrusion detector detects and intrusion; and a portable receiver adapted to be hand carried by a home owner, said portable receiver responsive to said modulated radio signal to generate a first visual signal and responsive to said radio signal transmitted after said preselected period of time to generate a second visual signal.

15. The home security system of claim 14 wherein said means for modulating is a blinker circuit producing an intermittent signal and said modulated radio signal is a time dependant intermittent radio signal.

16. The home security system of claim 15 wherein said first visual signal is a blinking visual signal and said second visual signal is a continuous signal.

17. The home security system of claim 14 wherein said intrusion detector further includes a battery connected to said intrusion detector means and a switch responsive to said intrusion detector mean's detecting an intrusion to connect said battery to said transmitter means and said timing means.

18. The home security system of claim 17 wherein said intrusion detector means is an infrared detector.

19. The home security system of claim 17 wherein said intrusion detector includes delay means for delaying the activation of said intrusion detector for a predetermined time after setting said intrusion detector to detect an intrusion to allow the homeowner sufficient time to exit said area to be monitored.

* * * * *

UNITED STATES PATENT AND TRADEMARK OFFICE

CERTIFICATE OF CORRECTION

PATENT NO. : 5,570,079

DATED : October 29, 1996

INVENTOR(S) : Devan Dockery

It is certified that error appears in the above-indentified patent and that said Letters Patent is hereby corrected as shown below:

In the Abstract, line 1, "flee-standing" should be --free-standing--.

Column 1, line 57, after "however" insert --,--.

Column 4, line 57, "all" should be --an--.

Signed and Sealed this

Ninth Day of September, 1997

*Attest:*

Bruce Lehman

BRUCE LEHMAN

*Attesting Officer*

*Commissioner of Patents and Trademarks*